US010138698B2

(12) United States Patent
Barnhart et al.

(10) Patent No.: US 10,138,698 B2
(45) Date of Patent: Nov. 27, 2018

(54) EXTERNAL LOCKING MECHANISM FOR SEAL ENERGIZING RING

(71) Applicant: Vetco Gray Inc., Houston, TX (US)

(72) Inventors: Daniel R. Barnhart, Houston, TX (US); David L. Ford, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 124 days.

(21) Appl. No.: 14/871,059

(22) Filed: Sep. 30, 2015

(65) Prior Publication Data

US 2017/0089162 A1 Mar. 30, 2017

(51) Int. Cl.
*E21B 33/04* (2006.01)
*E21B 23/02* (2006.01)

(52) U.S. Cl.
CPC ..... *E21B 33/04* (2013.01); *E21B 23/02* (2013.01); *E21B 33/0422* (2013.01)

(58) Field of Classification Search
CPC .. F16L 21/02; F16L 7/02; E21B 33/04; E21B 33/0422; E21B 23/02
See application file for complete search history.

(56) References Cited

U.S. PATENT DOCUMENTS 5,249,629 A 10/1993 Jennings
5,307,879 A 5/1994 Kent
8,127,857 B2 3/2012 Sinnott et al.
8,186,426 B2 5/2012 Nelson
8,701,786 B2 4/2014 Galle et al.
2013/0248196 A1 9/2013 Gette et al.
2013/0299193 A1* 11/2013 Duong ..... E21B 33/04 166/382
2014/0069646 A1 3/2014 Barnhart et al.

OTHER PUBLICATIONS

Milberger et al., "High-Performance Metal-Seal System for Subsea Wellhead Equipment", Offshore Technology Conference, pp. 411-422, May 1-4, 1989.
Christie et al., "Wellhead System To Pretension the Casing and Metal Seal the Annulus for Hot, Deep, Corrosive Wells", Offshore Technology Conference, pp. 423-428, May 1-4, 1989.

* cited by examiner

*Primary Examiner* — Carib A Oquendo
(74) *Attorney, Agent, or Firm* — Hogan Lovells US LLP

(57) ABSTRACT

A wellhead housing has a bore with a landing shoulder aid an annular retaining groove spaced above the landing shoulder. A casing hanger connects to a string of easing and lands on the landing shoulder. A seal assembly between the hanger and an interior side wall of the wellhead housing below the retaining groove has an energizing ring that moves axially downward relative to the seal member to a set position that causes the seal member to sealingly engage the hanger and the interior side wall. A lockdown member has an outer lower end portion that bears against an upper end of the energizing ring and an inner lower end portion that hears against an upper end of the hanger. A lockdown ring mounted to the lockdown member engages the retaining groove to prevent upward movement of the lockdown member.

20 Claims, 3 Drawing Sheets

EXTERNAL LOCKING MECHANISM FOR SEAL ENERGIZING RING

BACKGROUND

1. Field of Invention

The invention relates generally to a subsea wellhead assembly. More specifically, the invention relates to a casing hanger seal having an energizing ring that is locked in a set position by a lockdown member.

2. Description of Prior Art

Seals are topically inserted between subsea inner and outer wellhead tubular members to contain internal well pressure. The inker wellhead member is generally a banger for supporting either easing or tubing that extends mm the well. Outer wellhead members are wellhead housings or they can be a easing hanger when the inner member is a tubing hanger. A variety of seals located between the inner and outer wellhead members is known. Examples of known seals are elastomeric metal and combinations thereof. The seals may be set by a running tool, or they may be set in response to the weight of the string of easing or tubing. One type of metal-to-metal seal has seal body with inner and outer walls separated by a cylindrical slot, forming a "U" shape. An energizing ring pushed into the slot in the seal to deform the inner and outer walls apart into sealing engagement with the inner and outer wellhead members. The energizing ring is typically a solid wedge-shaped member. During setting, the deformation of the seal's inner and outer walls exceeds the yield strength of the material of the seal ring, making the deformation permanent.

The seal surfaces on the inner and outer wellhead members may have wickers. Wickers comprise a set of annular parallel grooves formed m the seal surface. Typically, the wickers have saw tooth shapes, defining valleys and crests. The setting tool forces the seal surfaces of the seal assembly against the wickers, causing the crests to embed into the seal surface.

Under certain circumstances high pressure cycles and temperature cycles can cause the energizing ring to move slightly upward. The upward movement of the energizing ring would cause a loss in the seal pressure rating. Proposals to prevent the upward loosening movement of the energizing ring include a variety of engagements between the energizing ring and the seal member.

It is also known to set a lockdown hanger or member in a wellhead housing bore above a casing hanger to prevent upward movement of the casing hanger. In one type, a split ring, when actuated, mates with annular retaining grooves formed in the wellhead housing bore. A wedge ring moves the split ring into the retaining ring grooves. The lockdown hanger running tool causes an actuating ring to expand a retainer ring into frictional engagement with the wellhead housing and the lockdown hanger to hold the wedge ring in the lower position. The lower end of this type of lockdown hanger engages only the casing hanger, not the seal assembly.

SUMMARY OF THE INVENTION

A wellhead apparatus includes an outer wellhead member having a bore with an axis. A hanger lands in the bore. A seal assembly between the hanger and an interior side wall of the outer wellhead member has an energizing ring that moves axially downward relative to the hanger to a set position that causes the seal assembly to set. A lockdown member secures in the bore against axial movement, the lockdown member having a lower end that bears against an upper end of the energizing ring while the energizing ring is in the set position.

Preferably, the lockdown member exerts a downward preload force against the energizing ring while the energizing ring is in the set position. In the preferred embodiment, the lower end of the lockdown member also bears against an upper end of the hanger.

Preferably, the lower end of the lockdown member has an outer portion that bears against the upper end of the energizing ring and an inner portion that beats against an upper end of the hanger. The outer portion is spaced axially above and radially outward from the inner portion.

In the example shown, an outer downward facing surface has an annular rib protruding downward and in contact with the upper end of the energizing ring. The lockdown member has an inner downward facing surface radially inward from and lower than the rib. The inner downward feeing surface is in contact with an upper end of the hanger.

The annular rib may be positioned between the outer periphery and the inner periphery of the outer conical surface. The rib may have a cylindrical outer surface and a cylindrical inner surface. The lockdown member preferably has a downward facing inner conical surface with an outer periphery at a lower elevation than the inner periphery of the outer conical surface and spaced radially inward from the energizing ring. The inner conical surface is in contact with an upper end of the hanger.

Preferably, an annular groove in the interior side wall of the outer wellhead member receives a lockdown ring mounted to the lockdown member. In the embodiment shown, the lockdown member has a tubular body having an upward facing exterior shoulder. The lockdown ring may be a split ring carried on the shoulder. An axially movable wedge ring encircles the tubular body and has an outward feeing cam surface that engages an inner diameter portion of the split ring. A radially deformable, axially movable retaining ring engages an upper end portion of the wedge ring. An axially movable actuating ring engages the retaining ring and when moved downward, pushes the retaining ring and the wedge ring downward. The downward movement expands the split ring into the groove and deforms the retaining ring into frictional engagement with the interior side wall of the outer wellhead member and with the lockdown member. The retaining ring is in non sealing engagement with the interior side wall of the outer wellhead member and with the lockdown member.

BRIEF DESCRIPTION OF DRAWINGS

Some of the features and benefits of the present invention having been stated, others will become apparent as the description proceeds when taken in conjunction with the accompanying drawings, in which.

Figure 1:
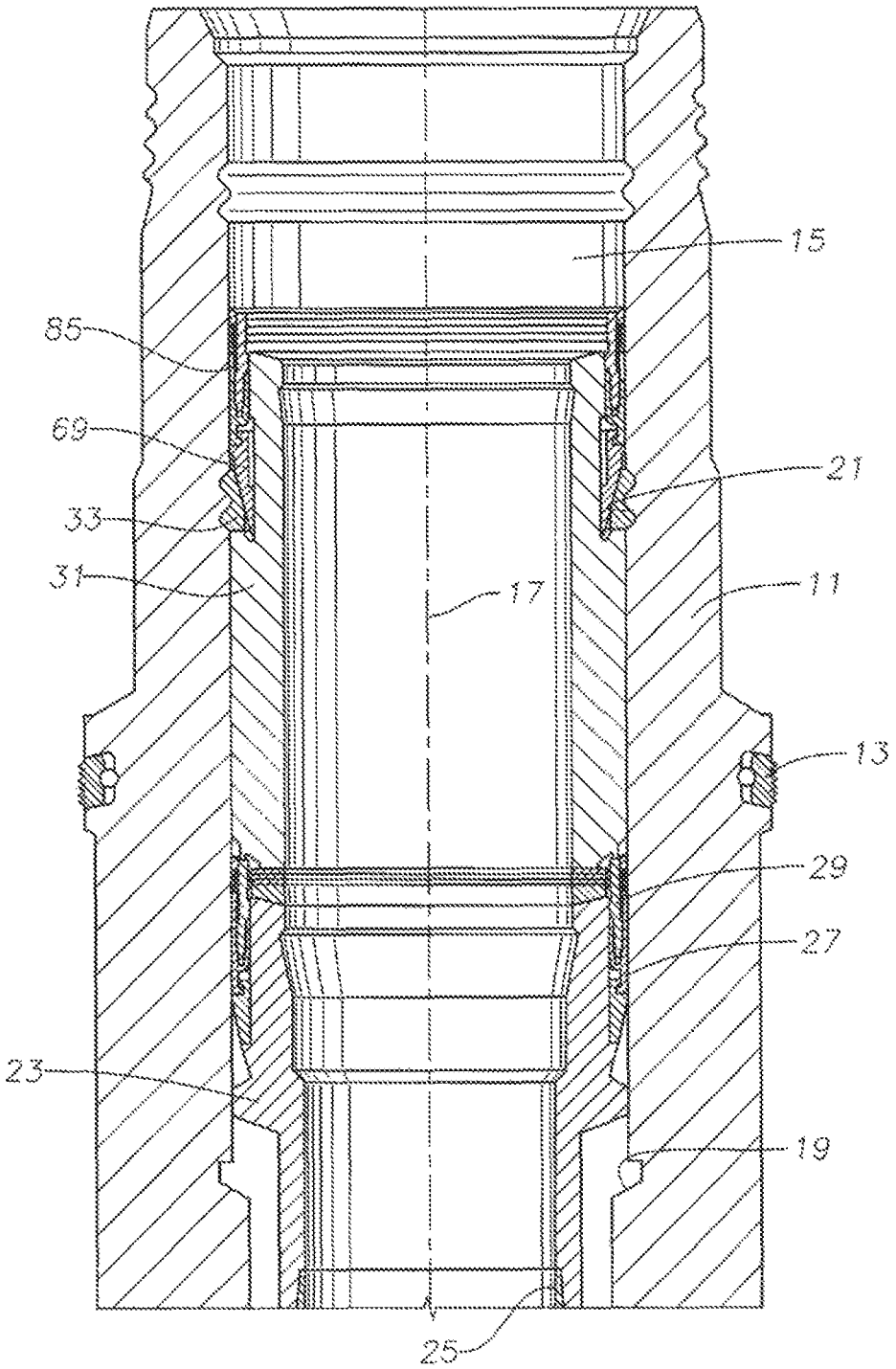
FIG. 1 is a sectional view of a subsea wellhead assembly having a seal and lockdown hanger in accordance with the present invention.

While the invention will be described in connection with, preferred embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

FIG. 1 illustrates a portion of a subsea wellhead assembly, including a wellhead housing 11. Wellhead housing 11 is a high pressure tubular member that lands within and may be secured by a latch 13 within a lower pressure housing (not shown). Wellhead housing 11 has a bore 15 and a longitudinal axis 17. Bore 15 has a landing shoulder 19 and one or more annular retaining grooves 21 located above. A casing hanger 23 secured to the upper end of a string of casing 25 lands on landing shoulder 19. Casing 25 extends into and is cemented in the well.

A seal member 27 seals between an outer diameter portion, of casing hanger 23 and wellhead housing 11. An energizing ring 29, when moved downward relative to seal member 27, deforms seal member 27 from a run-in configuration to a set configuration. High pressure cycles below seal member 27 and thermal cycles imposed on wellhead housing 11 and casing hanger 23 may tend to cause energizing ring 29 to work loose from its lower set position.

A lockdown hanger or member 31 secures within wellhead housing bore 15 to prevent upward movement of energizing ring 29 from the lower set position. Lockdown member 31 is a tubular member having a lower end bearing against the upper end of energizing ring 29 and also easing hanger 23 in this embodiment. A split ring 33 carried by lockdown member 31 engages one or more of the grooves 21 to prevent upward movement. Preferably, once locked by split ring 33, lockdown member 31 exerts a downward preload, force on energizing ring 29 and casing hanger 23.

Figure 2:
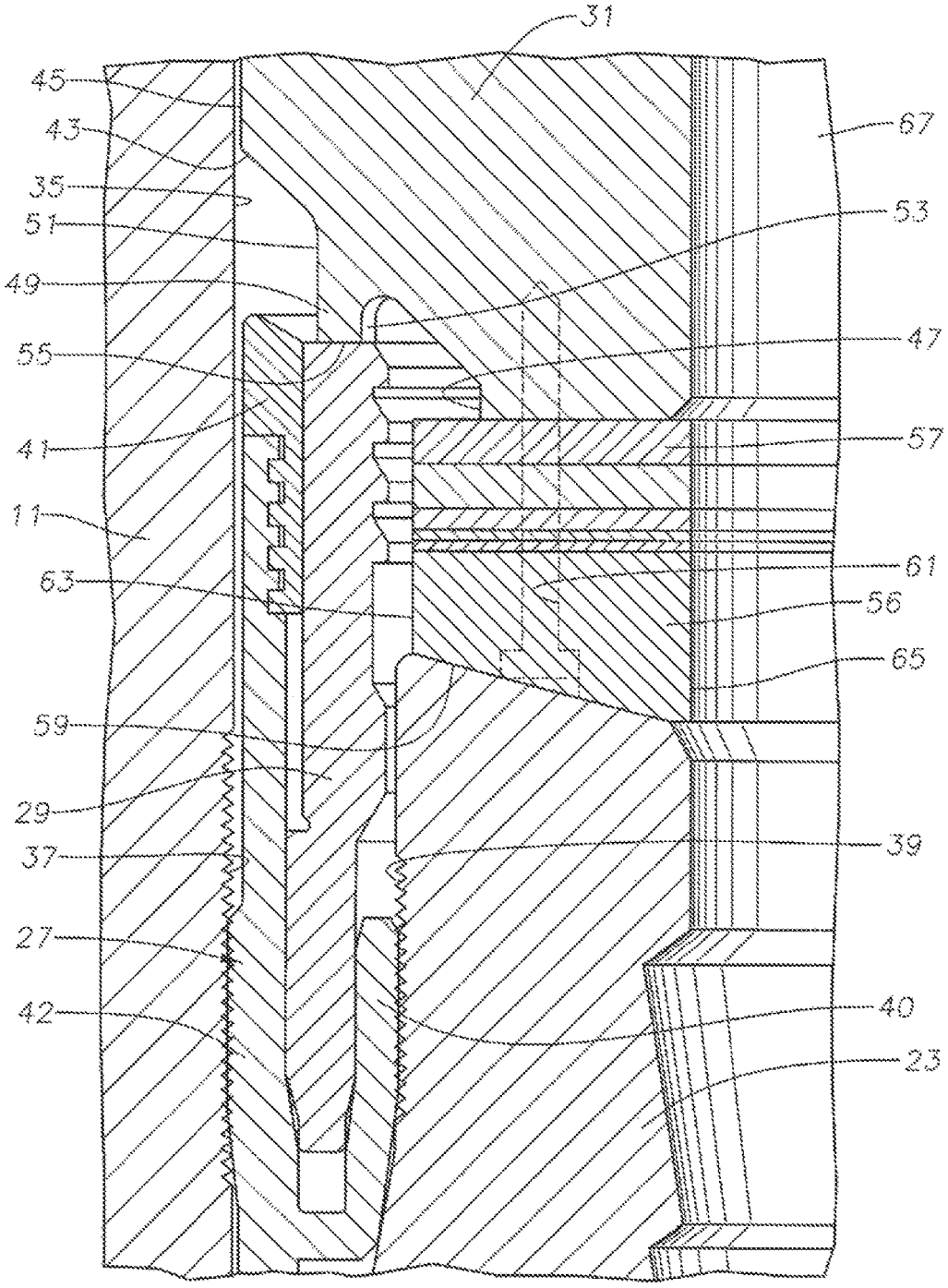
FIG. 2 is an enlarged sectional view of the seal of FIG. 1.

As shown in FIG. 2, an internal side wall 35 of wellhead housing 11 formed by bore 15 may have a set of wickers 37. Also, optionally, easing hanger 23 may have a set of wickers 39 radially inward from wellhead housing wickers 37. Wickers 37, 39 are small V-shaped grooves parallel with each other and in planes perpendicular to axis 17 (FIG. 1). Wickers 37, 39 are part of the seal surfaces of wellhead housing internal side wall 35 and casing hanger 23, and am not threads.

Seal member 27 may have a variety of configurations, but is preferably a metal-to-metal seal. In this example, seal member 27 has an annular inner leg 40 and m annular outer log 42 radially separated from each other by an annular slot. Energizing ring 29 has a lower portion with a greater width than the slot, such that when pressed downward into the slot, inner leg 40 deforms radially inward, into sealing engagement with casing hanger wickers 39. Outer leg 42 deforms radially outward into scaling engagement with wellhead housing wickers 37. The deformation is permanent not elastic. A ring 41 secures to outer leg 42 and provides an upper stop for energizing ring 29 if seal member 2 is to be retrieved.

In this embodiment, the lower end of lockdown member 31 has an outer portion 43 that may be conical, facing downward and outward relative to axis 17 (FIG. 1). Lower end outer portion 43 joins a cylindrical outer surface 45, which has an outer diameter slightly smaller than the inner diameter of wellhead housing interior side wall 35. In this example, lower end outer portion 43 has an inner periphery 47 that joins a short cylindrical surface of lockdown member 31 at a point above the upper end of easing hanger 23. At least part of lower end outer portion 43 is above seal member 2 and energizing ring 29.

Lower end outer portion 43 has a load bearing portion, which may be a rib 49 that bears against the upper end of energizing ring 29 after energizing ring 29 is in its lower set position. In this embodiment, rib 49 has an outer cylindrical wall 51 with an outer diameter less than the outer diameter of lockdown member cylindrical outer surface 45. Rib 49 may have an inner cylindrical wall 53 with, an inner diameter greater than the outer diameter of the upper end of casing hanger 23. Rib 49 depends from the conical surface of lower end outer portion 43 and is approximately equidistant between lockdown member outer cylindrical wall 45 and inner periphery 47 of lower end outer portion 43. Rib 49 has a lower end 55 that is flat and located in a plane perpendicular to axis 17 (FIG. 1). Rib lower end 55 is at a higher elevation than inner periphery 47 and abuts the flat upper end of energizing ring 29. In this embodiment the radial width of rib lower end 55 is no greater than the radial width of the upper end of energizing ring 29 and may be less.

The lower end of lockdown member 31 in this example has an inner portion that comprises a load bearing ring 56 with a conical lower side 59 that abuts and is flush with the conical upper end of casing hanger 23. Optionally, a number of shims or washers 57 may be installed between load bearing ring 56 and the lower end of the body of lockdown member 31. Washers 57 allow the distance from split ring 33 (FIG. 1) to the lower side 59 of load bearing ring 56 to be adjusted. Washers 57 may have a variety of thicknesses and are secured along with load bearing ring 56 to the body of lockdown member 31 by a number of fasteners or bolts 61.

The upper side of load bearing ring 56 and washers 57 are flat and in planes perpendicular to axis 17. The surface area of lower side 59 of load bearing ring 56 is approximately the same as the surfaces area of the upper end of casing hanger 23. Load hearing ring 56 may have a cylindrical outer surface 63 with an outer diameter less than the inner diameter of rib 49 to provide mom for the upper portion of energizing ring 29. Load bearing ring 56 may have a cylindrical inner surface 65 with an inner diameter equal to the inner diameter of a bore 67 extending through the body of lockdown member 31. The lower side 59 of load hearing ring 56 is at a lower elevation than rib lower side 55. The conical angle of lower end outer surface 43 is illustrated as being steeper than the conical angle of load hearing ring lower side 59 but the angles could be the same.

Figure 3:
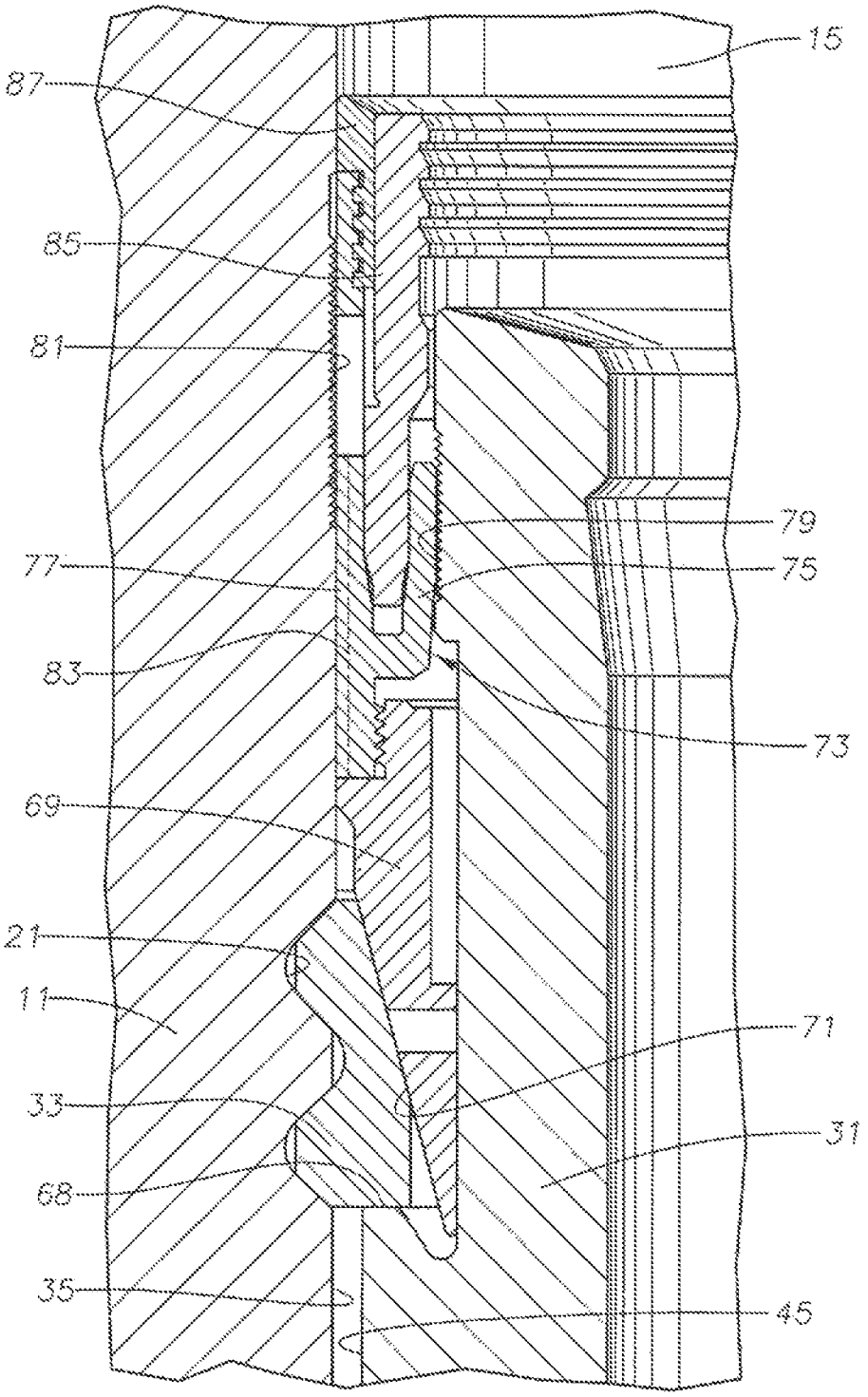
FIG. 3 is m enlarged sectional view of a portion of the lockdown hanger of FIG. 1.

Referring to FIG. 3, lockdown member 31 may be retained against axial upward movement a variety of ways.

In this embodiment, split ring 33 rests on an upward facing shoulder 68 on the exterior of lockdown member 31. Split ring 33 may have two lobes that mate with two of the wellhead housing retaining grooves 21. An axially movable non expansible wedge ring 69 encircles lockdown member 31 and has a downward and outward facing cam surface 71. Cam surface 71 slidingly engages a mating ramp surface on the inner diameter of split ring 33 when wedge ring 69 moves downward. Shear members (not shown) will temporarily retain wedge ring 69 in an upper position (not shown) during the running of lockdown member 31.

A retaining ring 73, when moved downward by a running tool (not shown), transfers a downward setting force to wedge ring 69, causing the shear members to shear and moving wedge ring 69 to the lower set position shown. Retaining ring 73 also will retain wedge ring 69 in the lower position. In this example, returning ring 73 has an annular inner leg 75 and an annular outer leg 77 separated by a slot in the same manner as seal member 27 (FIG. 2). An outer, upper, cylindrical portion of lockdown member 31 may have a set of wickers 79, Wellhead housing 11 may have a mating set of wickers 81 on its interior side wall 35. When set, inner leg 75 deforms against lockdown member wickers 79 and outer leg 77 deforms against wellhead housing wickers 81. To avoid hydraulic lock with the liquid in bore 15 above seal member 27 (FIG. 1), retaining ring 73 does not form a seal. At least one of the inner and outer legs 75, 77, which in this example is outer leg 77, contains vertical channels 83 through the portion that engages wickers 79 or 81 to prevent retaining ring 73 from forming a seal. Vertical channels 83 allow flow of liquid upward past the engaging surfaces of outer leg 77 and wellhead housing wickers 81.

An actuating ring 85, configured the same as energizing ring 29 (FIG. 2), serves to deform legs 75, 77 radially apart from each other. A running tool (not shown) for lockdown member 31 exerts a downward force on actuating ring 85, causing retaining ring 73 and wedge ring 69 to move downward to the set position shown in FIG. 3. Then, continued downward force causes actuating ring 85 to expand outer leg 77 into frictional engagement with wellhead housing wickers 81 and inner leg 75 into frictional engagement with lockdown member wickers 79. The expansion of retaining ring 73 is a permanent deformation. A retention ring 87 secures to the upper end of outer leg 7 to allow energizing ring 85 to be engaged by a retrieval tool and to pull retaining ring 73 upward in the event lockdown member 31 is to be retrieved.

During installation, the operator first runs casing hanger 23 and casing 25. After cementing casing 25, the operator employs the casing hanger running tool, (not shown) to move energizing ring 29 downward, setting seal member 27. Then the operator runs lockdown member 31 with the same or similar running tool, landing load bearing ring 56 on the upper end of casing hanger 23 and landing rib 49 on the upper end of energizing ring 29. The operator then moves actuating ring 85 downward, causing split ring 33 to engage retaining grooves 21 and retaining ring 73 to engage wickers 79, 81. The lockdown member dimensions selected preferably result in a downward preload force applied to energizing ring 29 and also to casing hanger 23.

The present, invention described herein, therefore, is well adapted to carry out the objects and attain the ends and advantages mentioned, as well as others inherent therein. While presently preferred embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A wellhead apparatus comprising:

an outer wellhead member having a bore with an axis;

a hanger landed in the bore;

a seal assembly between the hanger and an interior side wall of the outer wellhead member, the seal assembly having an energizing ring that moves axially downward relative to the hanger to a set position that causes the seal assembly to set; and a lockdown member secured in the bore against axial movement, the lockdown member having a lower end, and the lower end having an annular rib extending from a downward facing surface that bears against an upper end of the energizing ring while the energizing ring is in the set position.

2. The apparatus according to claim 1, wherein:

the lockdown member exerts a downward preload force against the energizing ring while the energizing ring is in the set position.

3. The apparatus according to claim 1, wherein:

the lower end of the lockdown member also bears against an upper end of the hanger.

4. The apparatus according to claim 1, wherein:

the lower end of the lockdown member has an outer portion that bears against the upper end of the energizing ring and an inner portion that bears against an upper end of the hanger; and the outer portion is spaced axially above and radially outward from the inner portion.

5. The apparatus according to claim 1, wherein the lower end of the lockdown member comprises:

an outer downward facing surface;

the annular rib in contact with the upper end of the energizing ring; and an inner downward facing surface radially inward from and lower than the rib, the inner downward facing surface being in contact with an upper end of the hanger.

6. The apparatus according to claim 1, wherein the lower end of the lockdown member comprises:

a downward and outward facing outer conical surface having an outer periphery and an inner periphery;

the annular rib joining and protruding downward from the outer conical surface between the outer periphery and the inner periphery into contact with the upper end of the energizing ring, the rib having a cylindrical outer surface and a cylindrical inner surface; and a downward facing inner conical surface having an outer periphery at a lower elevation than the inner periphery of the outer conical surface and spaced radially inward from the energizing ring, the inner conical surface being in contact with an upper end of the hanger.

7. The apparatus according to claim 1, further comprising:

an annular groove in the interior side wall of the outer wellhead member; and a lockdown ring mounted to the lockdown member and in locking engagement with the groove.

8. The apparatus according to claim 1, further comprising:

an annular groove in the interior side wall of the outer wellhead member; and wherein the lockdown member comprises:

a tubular body having an upward facing exterior shoulder;

a split ring carried on the shoulder;

an axially movable wedge ring encircling the tubular body and having an outward facing cam surface that engages an inner diameter portion of the split ring;

a radially deformable axially movable retaining ring in engagement with an upper end portion of the wedge ring; and an axially movable actuating ring that engages the retaining ring and when moved downward, pushes the retaining ring and the wedge ring downward to expand the split ring into the groove and which deforms the retaining ring into frictional engagement with the interior side wall of the outer wellhead member and with the lockdown member to retain the split ring in engagement with the groove.

9. The apparatus according to claim 8, wherein the retaining ring is in non sealing engagement with the interior side wall of the outer wellhead member and with the lockdown member.

10. A wellhead apparatus comprising:

a wellhead housing having a bore with an axis, a landing shoulder, and an annular retaining groove spaced above the landing shoulder;

a hanger landed on the landing shoulder;

a seal assembly between the hanger and an interior side wall of the wellhead housing below the retaining groove, the seal assembly having a seal member and an energizing ring that moves axially downward relative to the seal member to a set position that causes the seal member to sealingly engage the hanger and the interior side wall;

a lockdown member having an outer lower end portion, the outer lower end portion having an annular rib extending from a downward facing surface that bears against an upper end of the energizing ring and an inner lower end portion that bears against an upper end of the hanger; and a lockdown ring mounted to the lockdown member and in engagement with the retaining groove to prevent upward movement of the lockdown member.

11. The apparatus according to claim 10, wherein:

the lockdown member exerts a downward preload force against the energizing ring while the energizing ring is in the set position.

12. The apparatus according to claim 10, wherein:

the outer lower end portion is spaced axially above and radially outward from the inner lower end portion.

13. The apparatus according to claim 10, wherein:

the outer lower end portion is located in a plane perpendicular to the axis; and the inner lower end portion is a conical surface.

14. The apparatus according to claim 10, wherein the outer lower end portion of the lockdown member comprises:

the annular rib having a cylindrical outer side with an outer diameter less than an outer diameter of an outer periphery of the lockdown member.

15. The apparatus according to claim 10, wherein:

the outer lower end portion of the lockdown member comprises:

the annular rib having a cylindrical outer side wall and a cylindrical inner side wall;

the outer side wall having an outer diameter less than an outer diameter of an outer periphery of the lockdown member; and the inner lower end portion of the lock down member comprises:

a conical surface with an outer diameter less than an inner diameter of the inner side wall of the rib.

16. The apparatus according to claim 10, wherein:

the outer lower end portion of the lockdown member comprises:

an outer conical surface;

the annular rib having a cylindrical outer side wall and a cylindrical inner side wall;

the outer side wall having an outer diameter less than an outer diameter of the outer conical surface;

the inner side wall having an inner diameter greater than an inner diameter of the outer conical surface; the inner lower end portion of the lock down member comprises:

an inner conical surface with an outer diameter less than the outer diameter of the outer side wall; and the outer diameter of the inner conical surface is lower than the inner diameter of the outer conical surface.

17. A wellhead apparatus for sealing between an outer wellhead member having a bore with an axis and a hanger landed in the bore, comprising:

a seal member for positioning between the hanger and an interior side wall of the outer wellhead member;

an energizing ring that moves axially downward relative to the seal member to a set position that expands the seal member into engagement with the interior side wall and the hanger;

a tubular lockdown member having a lower end, the lower end having an annular rib extending from a downward facing surface that bears against an upper end of the energizing ring to prevent upward movement of the energizing ring while the energizing ring is in the set position, and the lockdown member having an annular upward facing shoulder;

a split ring carried on the shoulder;

an axially movable wedge ring encircling the tubular lockdown member and having an outward facing cam surface that engages an inner diameter portion of the split ring;

a radially deformable axially movable retaining ring extending upward from the wedge ring; and an axially movable actuating ring that engages the retaining ring and when moved downward, pushes the retaining ring and the wedge ring downward to expand the split ring into frictional engagement with the interior side wall of the outer wellhead member, and which deforms the retaining ring into frictional engagement with the interior side wall of the outer wellhead member and the lockdown member to retain the split ring in frictional engagement with the interior side wall with the outer wellhead member.

18. The apparatus according to claim 17, wherein:

the lockdown member is configured to exert a downward preload force against the energizing ring while the energizing ring is in the set position.

19. The apparatus according to claim 17, wherein:

the lower end of the lockdown member also bears against an upper end of the hanger.

20. The apparatus according to claim 17, wherein:

the lower end of the lockdown member has an outer portion that bears against the upper end of the energizing ring and an inner portion that bears against an upper end of the hanger; and the outer portion is spaced axially above and radially outward from the inner portion.

* * * * *